United States Patent [19]

Yamada et al.

[11] 3,957,016

[45] May 18, 1976

[54] DEVELOPER WRINGING AND REMOVING APPARATUS

[75] Inventors: Katsuhiko Yamada, Yokohama; Toshihide Iida, Tokyo, both of Japan

[73] Assignee: Canon Kabushiki Kaisha, Tokyo, Japan

[22] Filed: Sept. 26, 1973

[21] Appl. No.: 401,078

[30] Foreign Application Priority Data

Sept. 29, 1972 Japan ..... 47-97153

[52] U.S. Cl. ..... 118/637; 118/112; 118/114; 118/DIG. 23; 355/10; 427/15

[51] Int. Cl.[2] ..... G03G 15/10

[58] Field of Search ..... 118/637, DIG. 23, 112, 118/114; 117/37 LE; 355/10; 427/15

[56] References Cited

UNITED STATES PATENTS

| | | | |
|---|---|---|---|
| 2,937,390 | 5/1960 | Bolton et al. | 118/DIG. 23 |
| 3,299,787 | 1/1967 | Kolb et al. | 118/DIG. 23 |
| 3,424,126 | 1/1969 | Mahoney | 118/DIG. 23 |
| 3,577,259 | 5/1971 | Sato et al. | 118/DIG. 23 |
| 3,627,557 | 12/1971 | Sato et al. | 118/DIG. 23 |
| 3,711,796 | 1/1973 | Saito et al. | 118/DIG. 23 |
| 3,722,994 | 3/1973 | Tanaka et al. | 355/10 |
| 3,741,643 | 6/1973 | Smith et al. | 117/37 LE |
| 3,749,059 | 7/1973 | Sato | 118/DIG. 23 |
| 3,762,365 | 10/1973 | Herzog | 118/261 X |
| 3,782,818 | 1/1974 | Smith | 118/DIG. 23 |
| 3,784,297 | 1/1974 | Ito et al. | 118/637 X |
| 3,839,032 | 10/1974 | Smith et al. | 117/37 LE |

*Primary Examiner*—Mervin Stein
*Assistant Examiner*—Douglas Salser
*Attorney, Agent, or Firm*—Fitzpatrick, Cella, Harper & Scinto

[57] ABSTRACT

A liquid developer wringing and removing apparatus in a liquid development type electrophotographic copying machine is provided with a conductive member. The conductive member of the liquid developer wringing and removing apparatus is maintained at a ground potential and disposed behind a developing station in an electrophotographic process facing to the surface of a photosensitive member keeping a small clearance therebetween. By doing so, the toner remaining on non-image portions of the development can completely be removed and the excessive toner can also be squeezed out properly. A member for cleaning the conductive member or a corona discharger behind the conductive member can be provided additionally for further improvement of the present invention.

5 Claims, 8 Drawing Figures

DEVELOPER WRINGING AND REMOVING APPARATUS

BACKGROUND OF THE INVENTION

1. Field of the Invention

This invention generally relates to a developer wringing and removing apparatus. More particularly, the invention relates to a developer wringing and removing apparatus in a liquid developing transfer type electrophotographic copying machine which can eliminate fog by wringing excess developing solution stuck to the surface of a photosensitive member and by removing toner stuck to an undeveloped portion of the photosensitive member and floated in a layer of developer, after an electrostatic latent image on the photosensitive member has been liquid-developed.

2. Description of the Prior Art

In a liquid developing transfer type electrophotographic copying machine, developer is brought into direct contact with a photosensitive member for development so that upon completion of development a large amount of developer sticks to the surface of a photosensitive member. Therefore, toner also sticks to undeveloped portions of a photosensitive member and floats also in a layer of developer. Then, a high voltage corona discharger is employed to impart a corona discharge by means of its high current so as to be able to wring excess developer without disturbing a developed image and to remove toner adhering to the undeveloped portions and floating toner. However, recent requirement of high speed copying by a copying machine causes a moving speed of a photosensitive member (a rotational speed in case of a photosensitive drum) to extremely be speeded up. When this moving speed of a photosensitive member is high, excess developer may not sufficiently be removed only by the aforesaid high voltage corona discharger. This will require a higher voltage corona discharger. However, if it is too high, spark discharge or the like occurs in the corona discharger itself and between the corona discharger and the photosensitive member thus producing such disadvantages as to make pin-holes in the photosensitive member. A further disadvantage is such that when the corona discharging voltage is dropped, wringing effect of developer is reduced and drying in a drying process after transferring a developed image to a transfer material becomes insufficient, thus requiring a large capacity of a dryer. For these reasons, developer can not completely be wrung only by means of a corona discharger.

SUMMARY OF THE INVENTION

It is therefore an object of this invention to provide an improved developer wringing and removing apparatus which can completely wring and remove developer and eliminate fog in an electrophotographic copying machine.

It is a further object of this invention to provide an improved liquid developer wringing and removing apparatus in which an electrode roller maintained at an earth potential is provided above the surface of a photosensitive member bearing thereon liquid developer with a very small clearance therebetween to eliminate fog and at the same time remove excess developer.

It is another object of this invention to provide an improved liquid developer wringing and removing apparatus in which member for always cleaning the surface of the electrode roller is provided to thereby always wring and remove liquid developer and eliminate fog in stabilized condition.

It is yet another object of this invention to provide an improved liquid developer wringing and removing apparatus in which said cleaning member is composed of liquid absorptive material so that said cleaning member is not dried when the copying machine is not operated.

It is still another object of this invention to provide an improved liquid developer wringing and removing apparatus in which a thin plate is attached to said electrode roller surface to serve as an auxiliary cleaning member, thus improving cleaning effect for said electrode roller surface.

It is a further object of this invention to provide an improved liquid developer wringing and removing apparatus in which a corona discharger is provided to be positioned behind said electrode roller by which developer is wrung and removed in order to perform further wringing and removing operation, thus completely performing wringing and removing developer and eliminating fog even in a high speed electrophotographic copying machine.

Features of the invention, other than those adverted to, will be apparent from the hereinafter detailed description when read in conjunction with the accompanying drawings.

That is, the invention is to provide an electrode maintained at an earth potential opposite a photosensitive member and held in fine spaced relation with a photosensitive layer immediately behind the developing station to thereby wring developer remaining on the photosensitive layer and to eliminate fog after development.

An electrostatic latent image formed by the hereinafter described electrophotographic process has, for example, its bright portion of negative (−) 100V and its dark portion of positive (+) 500V, which are reverse polarities from each other, and therefore in the electrode portion where maintained at an earth potential, toner in image portion is further attracted to the image itself and toner in non-image portion is repulsed.

DESCRIPTION OF THE PREFERRED EMBODIMENTS

The invention will now be described in detail with reference to the drawings.

Figure 1:
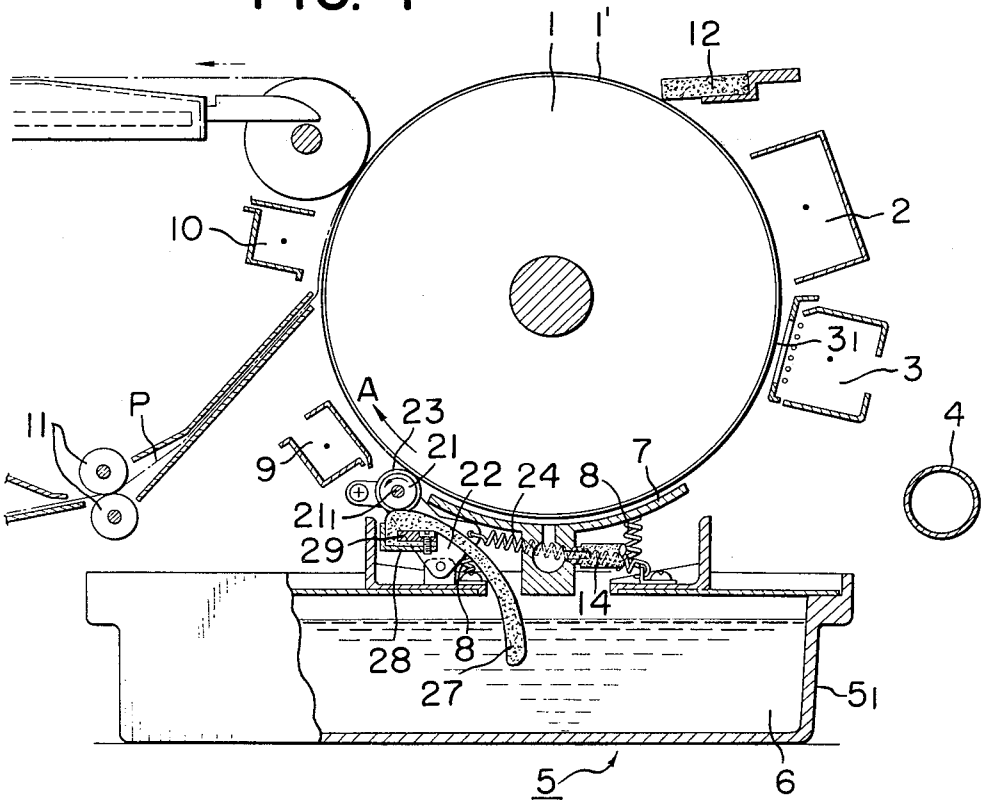
FIG. 1 is a cross section of an electrophotographic copying machine provided with a developer wringing and removing apparatus according to this invention.

Referring now to FIG. 1, a photosensitive drum 1 is covered with a photosensitive layer 1' having a surface insulating layer and a photoconductive layer and rotates in a clockwise direction A. The photosensitive drum 1 is first positively (+) or negatively (−) charged by means of primary charger 2, and in an exposure portion $3_1$ an original image is slit-exposed by means of a known optical means and at the same time subjecting to a.c. discharge or a secondary charge having a polarity reverse to that of a primary charge by means of a corona charger 3. Then, an electrostatic latent image is formed on the surface of the photosensitive drum by means of a total exposure through a lamp 4. Further, said discharge and charge may be made immediately after the exposure of the image. The image is then liquiddeveloped by developer in a developing device 5. This developing device 5 comprises a vessel 6 for containing therein liquid developer $5_1$, a pump (not shown) which stirs and pumps up the liquid developer $5_1$, and a developing electrode 7, which is always urged against the photosensitive drum 1 with a small clearance therebetween. The electrostatic latent image formed on the photosensitive drum 1 is developed and visualized by toner in the liquid developer raised onto the developing electrode 7 by means of the pump.

Next, receiving corona discharge by means of a post corona discharge 9, excess liquid developer on the photosensitive drum 1 is wrung or squeezed out without disturbing the image. On the other hand, a transfer sheet P fed by a roller 11 from a paper feed station is brought into close contact with the photosensitive drum 1 and an image on the photosensitive drum 1 is transferred onto the transfer sheet P through the charge of a transfer charger 10, and the transfer sheet P already transferred is separated by means of separating means such as a separating belt and is introduced into drying and fixing stations. Thereafter, toner and developer remaining on the photosensitive member 1 are wiped off by means of a blade cleaner 12 pressed thereon, and then next cycle is repeated.

In order that the developing electrode is disposed opposite the photosensitive member, as previously described, and liquid developer is filled in a small clearance therebetween to visualize an image on the surface of the photosensitive member, it is important to consider welling-out condition of the liquid developer so that the liquid developer may be spread on the surface of the photosensitive member uniformly to form an even image.

Figure 2:
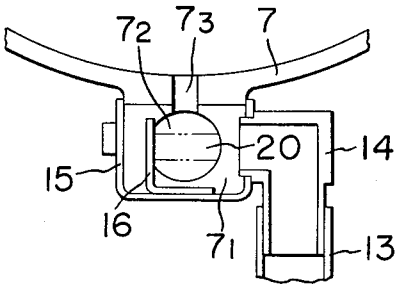
FIGS. 2, 3 and 4 are a cross section, a longitudinal section, and a plan view, respectively, of a developing electrode of the developing device.
Figure 3:
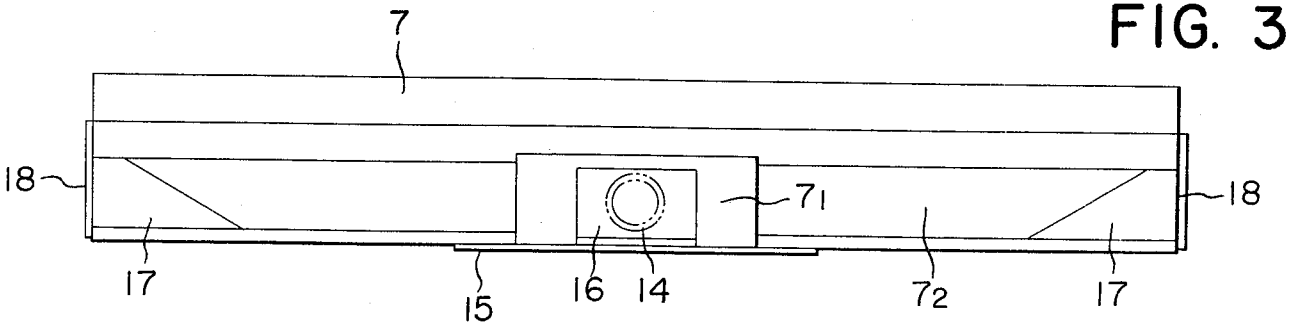
Figure 4:
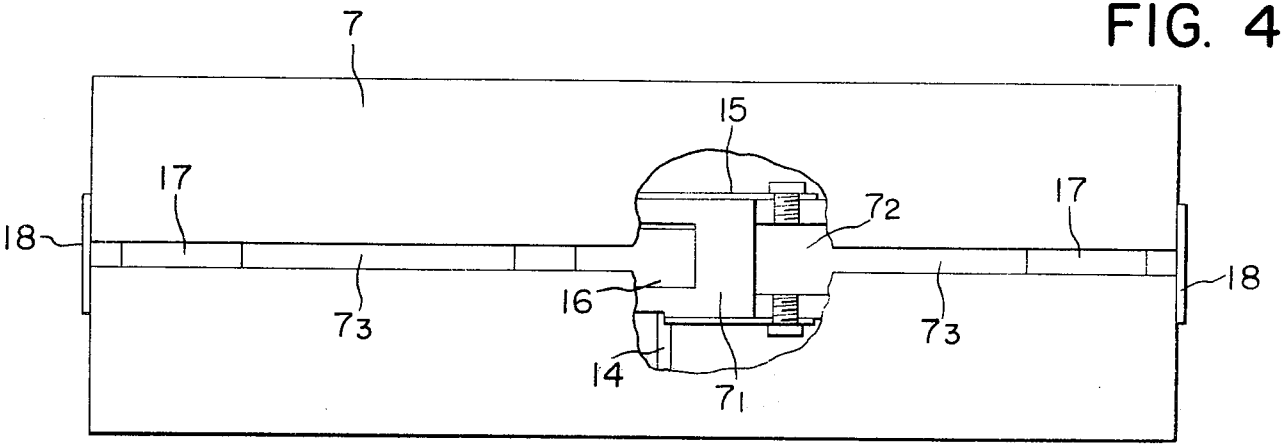

In FIGS. 2, 3 and 4, there is shown a developing electrode 7, a liquid reservoir $7_1$ provided at a central portion in a lengthwise direction (that is, in the edge line direction of the photosensitive drum) of the developing electrode, a passage $7_2$ for flowing the liquid developer, and a liquid wellout groove $7_3$. There is further shown a liquid feed tube 13 for feeding liquid from a liquid developer feed pump (not shown), a liquid feed inlet 14, a liquid reservoir cover 15, and a diffusing plate 16 perpendicular to the inlet 14 and the distance from the inlet 14 being adjustable. The reference numeral 17 designates a liquid stop member and 18 designating a liquid stop plate.

Figure 5:
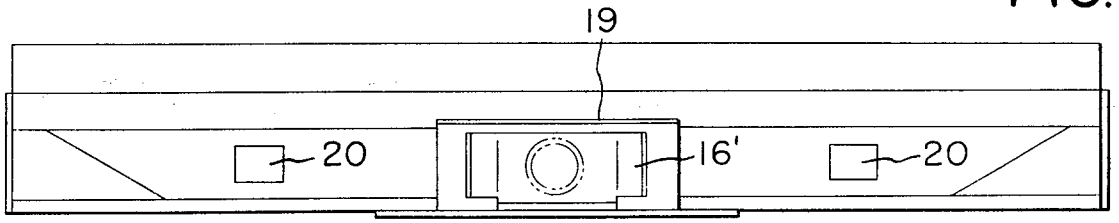
FIGS. 5 and 6 are a longitudinal section and a plan view, respectively, of a developing electrode in accordance with other embodiments.
Figure 6:
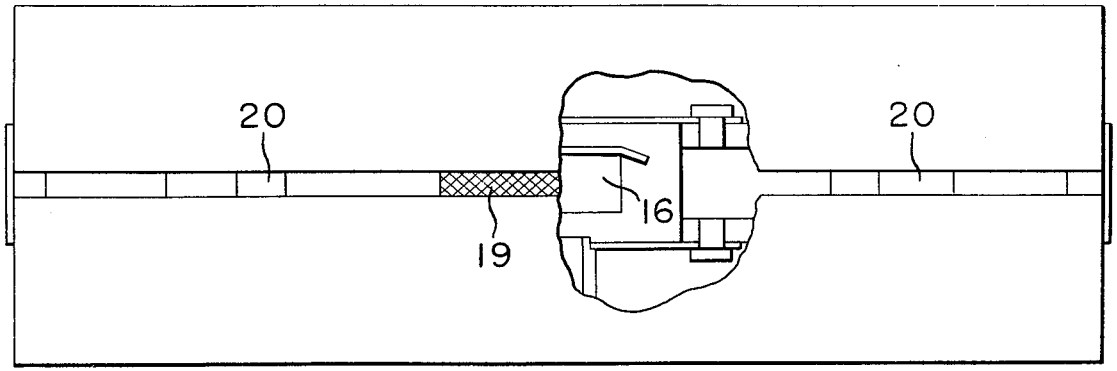
Figure 7:
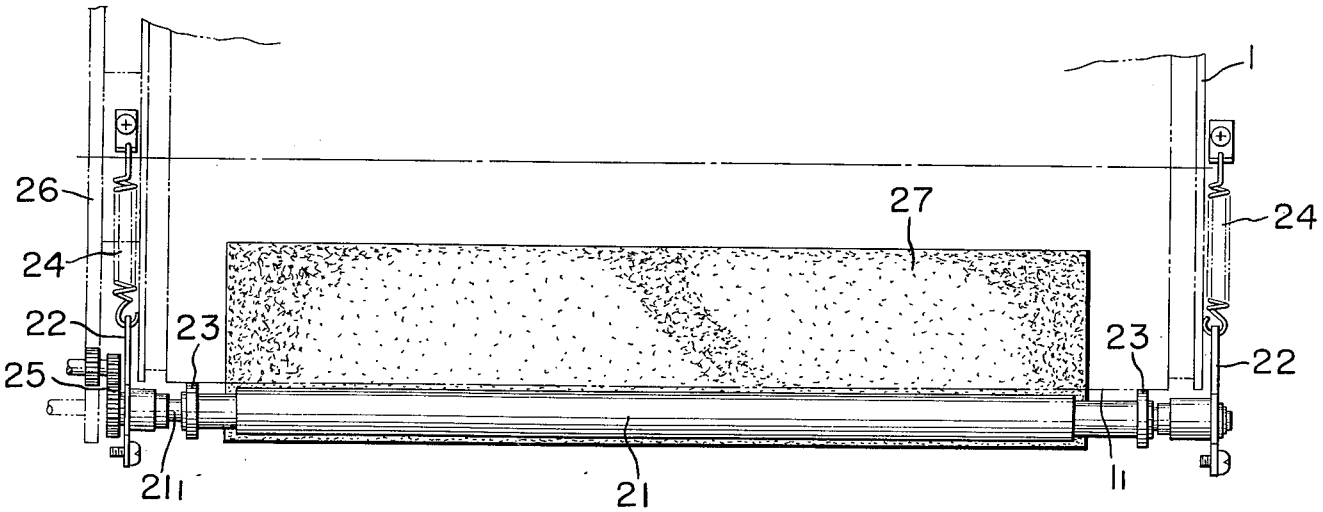
FIG. 7 is a plan view of the developer wringing and removing apparatus in accordance with this invention.
Figure 8:
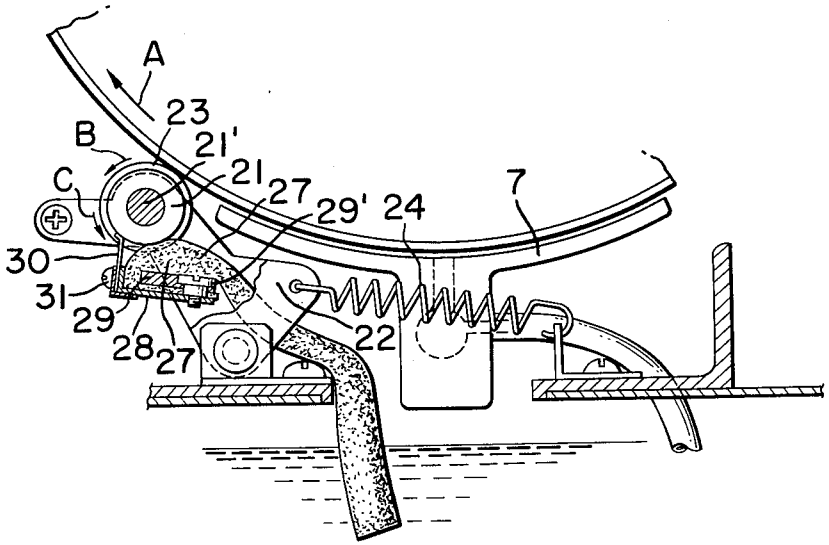
FIG. 8 is a side view of FIG. 7.

In FIGS. 5 and 6, there is shown an interfering member 19 such as net and an intermediate member 20, the position of which is adjustable.

Liquid developer fed from the supply pump flows into the liquid reservoir $7_1$ from the inlet 14 through the liquid feed tube 13. At this time, if the liquid feed inlet 14 directly faces to the liquid well-out groove $7_3$, the well-out amount of the liquid developer will increase only in the central portion where the liquid feed inlet 14 is positioned so that the liquid developer may not spread uniformly. Therefore, the liquid feed inlet 14 is directed in such a direction that liquid developer flows into the liquid reservoir $7_1$ is not directly directed at the well-out groove $7_3$, the diffusing plate 16 is arranged ahead thereof and thus liquid flowing from the liquid feed inlet 14 impinges upon the diffusing plate 16, a part of the liquid is upwardly raised while the other part thereof rebounds and is diffused while impinging upon the walls of the liquid reservoir cover 15 and fully entering the liquid reservoir $7_1$. The liquid is then pushed towards $7_2$ and gradually welled out upwardly and welling up while being interferred by the liquid stop member 17 and the liquid stop plate 18, and finally welling out uniformly from the upper well-out groove $7_3$.

However, since the welling out condition may be varied with the change in a flow-in speed of liquid from the liquid feed inlet 14 and the flow-in amount thereof depending upon the capacity of the pump, or change in length of the electrode 7, an adjusting portion is provided as will be explained in the following.

To copy with the change in the flow-in speed of liquid and the flow-in amount thereof, the size of the diffusing plate 16 or the distance from the liquid feed inlet 14 are varied, or the shape of the diffusing plate 16 is varied by bending the end as shown in FIGS. 5 and 6 to thus change a diffusing condition of liquid within the liquid reservoir $7_1$ and a raising condition of liquid, whereby the balance in a well-out condition may be adjusted between the central portion and the end of the developing electrode.

In addition, in the event that the well-out amount in the central portion is excessively great, an interfering member 19 such as net is mounted at the top of the central liquid reservoir $7_1$ as shown in FIGS. 5 and 6 to properly adjust the amount thereof by controlling courseness of net mesh.

If the length of the developing electrode 7 is longer, since the well-out amount in the intermediate portion would sometimes be reduced as compared with the central portion and the end thereof, an intermediate member 20 is provided and by adjusting the position thereof a part of the liquid developer flowing into the end is raised to increase the well-out amount in the intermediate portion.

With the construction as described above, the liquid developer fed from the feed pump through the liquid feed tube may evenly be spread on the surface of the photosensitive member to form an even image.

An apparatus of the invention is interposed between the developing station 5 and the charger 9 as described above. That is, a roller member 21 of conductive material is carried by left and right pivotal arms 22 supported on the shafts of a developing unit and is mounted in parallel to the photosensitive drum 1, spacer rollers 23 are mounted on both ends of said roller member 21, and said spacer rollers 23 are pressed against a photosensitive layer 1' of the photosensitive drum 1 by means of a spring 24 retained between the arms 22 and the developing unit, and said roller member 21 is opposedly disposed relative to the photosensitive layer 1' in fine spaced relation, for example, of from 0.1 to 0.2mm. This space is principally determined depending upon the potential of the non-image portion, preferably between 0.1mm and 2mm. A gear 25 is provided on a shaft $21_1$of the roller member 21 in interlocking relation with a driving gear 26 of the photosensitive drum 1, causing the roller member 21 to be rotated in a direction opposite the photosensitive drum as indicated by the arrow B.

There is shown a cleaner 27, which is elastic such as rubber or Moltoprene, mounted by a set-screw 29' through a retractable holding member 29 to a receiving member 28 integral with the swing arm 22, said cleaner being partly pressed against the roller member 21. The numeral 30 designates a thin insulative (or conductive) film, for example, Myla (trade Mark) or the like, mounted by means of a screw 31 on the receiving member 28, a free end of the film being placed in contact with the roller member 21.

In a liquid developing transfer type electrophotographic copying machine, liquid developer is directly placed in contact with the photosensitive member for development so that liquid developer sticks to the surface of the photosensitive body. Therefore, toner sticks also to the non-image portion. Then, it is to wring excess liquid developer and inevitably to remove toner contained in the liquid developer remaining on the nonimage portion using the high voltage charger 9, but the liquid developer can not sufficiently be removed when the drum rotates faster. It is therefore required to have a higher voltage discharger but if it is too high, spark discharge occurs in the charger itself and between the charger and the photosensitive drum, thus producing such disadvantages as to make pin-holes in a photosensitive layer. On the other hand, if the voltage of the charger is lowered, wringing effect of the developer is reduced, drying becoming insufficient to thus require a large capacity of a dryer. Therefore, a complete wringing of the developer may not be attained only by the charger 9.

In the light of this respect, the invention is to provide a roller-like conductive member 21 between the developing station 7 and the high voltage charger 9 in fine spaced relation with the drum 1 so that excess liquid may be wrung and toner adhering to the non-image portion may be removed, further the remaining liquid may be wring by means of the high voltage charger 9, thereby eliminating fog and improving the drying effect without increasing the voltage of the charger.

In this case, toner is liable to successively stick to the conductive member 21 to cover thereover. Under the condition, the toner attractive force of the member 21 is reduced and fog eliminating effect is decreased. Therefore, the cleaner member 27 is employed to always clean the surface of the conductive member. In this case, toner removed from the conductive member 7 is gradually accumulated between the conductive member 21 and the cleaning member 27, and the cleaning effect may be maintained when toner mass being wet with liquid developer. However, when not in operation toner mass is dried and sticks in solid state to the cleaning member thus adversely affecting the cleaning action for the succeeding copying operation and decreasing the fog-eliminating effect. To copy with this, a member having capillarity and being able to always contain liquid (e.g., fine mesh urethane foam) is used, one end 27' of which is immersed in liquid developer so as to keep the toner thus removed always wet.

Further, when a thin film 30 is provided in front of the cleaning member 27 and is pressed against the conductive member 21, toner stuck to the conductive member 21 may be removed by the tip end thereof and washed away with liquid developer in a direction as indicated by the arrow C, thus reducing toner stuck to the cleaner 27 and maintaining the cleaning effect of the cleaning member 27, further improving durability.

This invention provides such effects that elimination of fog and wringing of developer may effectively be performed, the voltage of the charger 9 for successive wringing may be decreased, and the thermal capacity of the dryer may be reduced.

1. An electrophotographic copying apparatus comprising:

a rotatable member;

means for forming an electrostatic latent image on said rotatable member;

means for applying a liquid developer to said rotatable member for developing the electrostatic latent image formed thereon;

liquid developer restricting means including a squeezing roller for removing excess liquid developer from said rotatable member, said squeezing roller being disposed spaced apart from said rotatable member and at a position where the surface of said rotatable member moves upwardly;

spacer roller means for maintaining said spaced apart relation between said squeezing roller and said rotatable member wherein said spacer roller means rotates in contact with said rotatable member;

means for rotating said squeezing roller to remove the excess liquid developer from said rotatable member; and means for establishing a potential condition at said squeezing roller to prevent fog at non-developed areas of the rotatable member, wherein said formation of said latent image results in unequal potentials at imaged and non-imaged areas of said rotatable member, and wherein a potential is maintained on said squeezing roller at a value intermediate that of the imaged area and that of the non-imaged area of said rotatable member.

2. An electrophotographic copying apparatus comprising:

a rotatable member;

means for forming an electrostatic latent image on said rotatable member;

means for applying a liquid developer to said rotatable member for developing the electrostatic latent image formed thereon;

liquid developer restricting means including a squeezing roller for removing excess liquid developer from said rotatable member, said squeezing roller being disposed spaced apart from said rotatable member and at a position where the surface of said rotatable member moves upwardly;

spacer roller means for maintaining said spaced apart relation between said squeezing roller and said rotatable member, wherein said spacer roller means comprises two spacer rollers disposed adjacent opposite ends of said rotatable member for rotation in contact with said rotatable member;

means for rotating said squeezing roller to remove the excess liquid developer from said rotatable member; and further comprising means wherein said spacer rollers are urged against and driven by said rotatable member.

3. An electrophotographic copying apparatus comprising:

a rotatable member;

means for forming an electrostatic latent image on said rotatable member;

means for applying a liquid developer to said rotatable member for developing the electrostatic latent image formed thereon;

liquid developer restricting means including a squeezing roller for removing excess liquid developer from said rotatable member, said squeezing roller being disposed spaced apart from said rotatable member and at a position where the surface of said rotatable member moves upwardly;

spacer roller means for maintaining said spaced apart relation between said squeezing roller and said rotatable member wherein said spacer roller means rotates in contact with said rotatable member;

means for rotating said squeezing roller to remove the excess liquid developer from said rotatable member; and further comprising means for rotatably supporting said squeezing roller and said spacer roller means and for urging said spacer roller means against a surface of said rotatable member.

4. An electrophotographic copying apparatus comprising:

a cylindrical rotatable member having an electrophotographic photosensitive surface;

means for forming an electrostatic latent image on said surface in accordance with an image of an original, said latent image forming means being disposed at a position where the surface of said rotatable member rotates downwardly;

means for applying a liquid developer to said surface for developing the electrostatic latent image formed thereon, said developing means being disposed at a lower portion of the rotatable member;

liquid developer restricting means including a squeezing roller for removing excess developing liquid from the surface of said rotatable member, said roller being disposed at a small distance from the surface of the rotatable member and at a position where the surface moves upwardly;

two spacer rollers for maintaining a constant clearance between the squeezing roller and the surface of the rotatable member, said spacer rollers being in contact with the surface of said rotatable member adjacent the ends thereof;

means for urging said spacer rollers into contact with the rotatable member to be rotated by said rotatable member;

means for rotating the squeezing roller;

means for establishing a potential condition at the roller to prevent fog at non-developed areas of said surface;

first cleaning means for cleaning developing liquid from the surface of the squeezing roller, said first cleaning means being so disposed that the removed developing liquid is deposited in the developing means;

means for transferring the developed image onto a transfer material, said transfer means being disposed downstream of said squeezing roller in the direction of movement of said rotatable member; and second cleaning means for cleaning the surface of the photosensitive member after said transfer of the developed image, said second cleaning means being disposed at a position where the surface of the rotatable member moves downwardly.

5. An electrophotographic copying apparatus comprising:

a rotatable member;

means for forming an electrostatic latent image on said rotatable member; formation said information of said latent image results in unequal potentials at imaged and non-imaged areas of said rotatable member;

means for applying a liquid developer to said rotatable member for developing the electrostatic latent image formed thereon;

liquid developer restricting means including a squeezing roller for removing excess liquid developer from said rotatable member, said squeezing roller being disposed spaced apart from said rotatable member and at a position where the surface of said rotatable member moves upwardly;

means for maintaining a potential on said squeezing roller at a value intermediate that of the imaged area and that of the non-imaged area of said rotatable member; and, means for rotating said squeezing roller to remove the excess liquid developer from said rotatable member.

* * * * *

UNITED STATES PATENT OFFICE

CERTIFICATE OF CORRECTION

Patent No. 3,957,016 Dated May 16, 1976

Inventor(s) KATSUHIKI YAMADA and TOSHIHIDE IIDA

It is certified that error appears in the above-identified patent and that said Letters Patent are hereby corrected as shown below:

Column 5, line 38, delete "wring" and insert --wrung--.

Claim 5, line 5, delete "formation said information" and insert --wherein said formation--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*